United States Patent [19]

Golinsky, Jr.

[11] Patent Number: 4,537,394

[45] Date of Patent: Aug. 27, 1985

[54] EXERCISE APPARATUS FOR DEVELOPING ARM AND WRIST MUSCLES

[76] Inventor: Joseph J. Golinsky, Jr., 357 Henry St., Hellertown, Pa. 18055

[21] Appl. No.: 542,679

[22] Filed: Oct. 17, 1983

[51] Int. Cl.[3] ..... A63B 21/06

[52] U.S. Cl. ..... 272/117; 272/122; 272/143; 272/93

[58] Field of Search ..... 272/117, 136, 122, 123, 272/128, 93, 134, 143, 118, 116, 124

[56] References Cited

U.S. PATENT DOCUMENTS

| | | | |
|---|---|---|---|
| 588,350 | 8/1897 | Perkins | 272/117 X |
| 1,529,959 | 3/1925 | Martin | 273/79 |
| 2,640,696 | 6/1953 | Lemieux | 272/123 |
| 3,290,044 | 12/1966 | Krodsen et al. | 272/117 |
| 3,502,329 | 3/1970 | Brazier | 272/117 |
| 3,690,655 | 9/1972 | Chapman | 272/117 X |
| 4,239,210 | 12/1980 | Lambert | 272/134 X |
| 4,377,282 | 3/1983 | Hayes | 272/128 X |
| 4,403,772 | 9/1983 | Stangle | 272/117 X |
| 4,408,759 | 10/1983 | Reneau et al. | 272/134 X |

FOREIGN PATENT DOCUMENTS

| | | | |
|---|---|---|---|
| 622320 | 4/1949 | United Kingdom | 272/117 X |

*Primary Examiner*—Richard J. Apley
*Assistant Examiner*—Robert W. Bahr
*Attorney, Agent, or Firm*—Ruth Moyerman

[57] ABSTRACT

An adjustable weight lifting device including an angled longitudinal bar fitted with an arm brace at its proximal end, and a stop at its distal end. On the longitudinal bar between the arm brace and the longitudinal bar's angle is a slidably mounted crossbar which the user grasps with his hands. Adjustable handles may be placed on the crossbar to provide different exercises for the arm muscles. A slidable carriage assembly to receive supplemental weights is mounted on the longitudinal bar between its angle and its distal end. The user achieves variety in his exercise by adjusting the crossbar, the handles and the carriage assembly, and by adding supplemental weights.

17 Claims, 11 Drawing Figures

Fig. 1
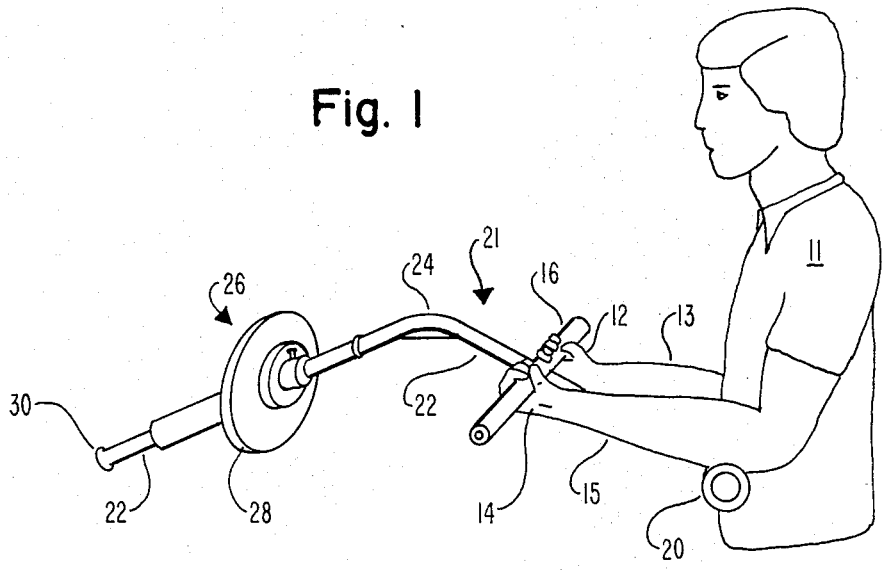
Fig. 2
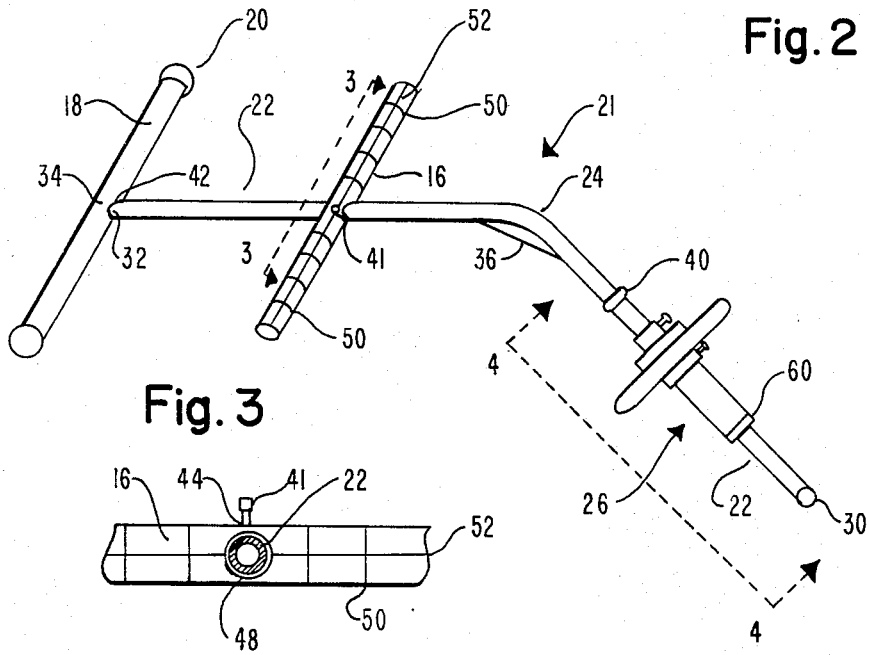
Fig. 3

EXERCISE APPARATUS FOR DEVELOPING ARM AND WRIST MUSCLES

BACKGROUND OF THE INVENTION

1. Field of the Invention

This invention relates to exercising equipment, and more particularly to user manipulated weights for exercising arms and wrists.

2. Description of the Prior Art

In recent years there has been a great emphasis on physical fitness. There has been a great demand for apparatus to help a person become stronger and more physically fit. Some devices are designed to be best used in a commercial health spa or gymnasium. The more sophisticated of these devices are often too complex or bulky to be used in a home. The more simple devices do not offer the user the variety of commercial devices. The more complex devices often require the use of a curling bench.

There is, therefore, a great need for an adjustable weight lifting apparatus which will exercise a number of different muscles in the arms and wrists of the user. There is a need for a device which offers variety with only simple adjustments to the apparatus.

Also, there is a need for an exercise apparatus which is suitable for use in the home as well as providing adaptability for use in a commercial establishment without requiring the use of a curling bench.

SUMMARY OF THE INVENTION

The aforementioned prior art problems are obviated by the device of this invention in which a longitudinal bar with an angle proximate its midpoint has an arm brace mounted perpendicularly on the bar's proximal end. The bar's angle prevents the distal end of the longitudinal bar from hitting the user. The device also includes an adjustable crossbar on which handles may be placed, and a carrier assembly to provide for supplemental weights.

In use, the weight lifter places the arm brace under his forearms, grasps the crossbar with one hand on each side of the longitudinal bar, and raises and lowers the distal end of the apparatus while bending the arm at the elbow in a curling motion. Supplemental weights, slidably mounted on the carriage assembly at the distal end of the longitudinal bar, provide greater resistance for the advanced user.

Additionally, handles may be slidably and rotatably mounted on the crossbar. The handles adjust also at angles in the plane of the crossbar. These various adjustments of the handles allow the user to exercise different muscles of arm and wrist depending on the position of his hands as they grasp the handles.

It is, therefore, an object of this invention to provide a device for exercising the muscles of the arm and wrist.

It is another object of this invention to provide an adjustable device which will exercise separate muscle groups according to the desire of the user.

It is yet another object of this invention to provide a device to which supplemental weights may be added.

It is a further object of this invention to provide an easily adjustable exercise apparatus suitable for use in the home or a commercial establishment.

It is still another object of this invention to provide an exercise device which does not require the use of a curling bench.

It is yet a further object of this invention to provide an exercise device which offers both crude adjustment by adding weights, and fine adjustment by moving the carriage assembly.

It is still a further object of this invention to provide a safe, adjustable, efficient and easy to use weight lifting device.

It is yet another object of this invention to provide a device which, by the addition of handles, allows for a variety of hand and arm positions to affect the manner in which muscles are utilized.

These and other objects will be more readily ascertainable to one skilled in the art from a consideration of the following Figures, descriptions and exemplary embodiments.

BRIEF DESCRIPTION OF THE DRAWING(S)

FIG. 1 depicts the device of this invention being lifted by a user.

FIG. 2 is a isometric of the apparatus.

FIG. 3 is a cross section taken along lines 3—3 of FIG. 2.

DETAILED DESCRIPTION OF THE PREFERRED EMBODIMENT(S)

Figure 8:
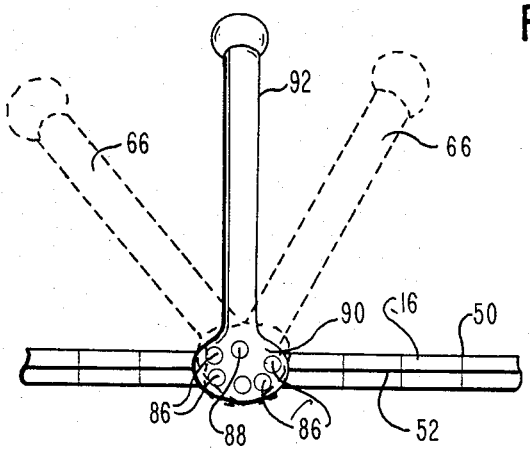
FIG. 8 is a top view of the handle of this invention including alternate settings in phantom.

Referring now to the drawings, and more particularly to FIG. 1, weight lifter 11 is shown holding crossbar 16 of weight lifting apparatus 21. Weight lifter 11 has right hand 12 and left hand 14 grasping crossbar 16 with palms of hands 12 and 14 facing upward. With hands 12 and 14 in this position and with forearms 13 and 15 resting on arm brace 18 (seen in FIG. 2), the user is in position to perform bicep curls for strengthening biceps and other arm or wrist muscles.

Also shown in FIG. 1 is arm brace cap 20 which prevents a user's arm from slipping off arm brace 18 (seen in FIG. 2).

Weight lifting apparatus 21 is shown in FIG. 1 in exercising position where angle 24 of longitudinal bar 22 is facing downward. By angling bar 22 downward, the risk of bar 22 hitting the user's head when he is lifting is reduced.

Carriage assembly 26 is slidably mounted on longitudinal bar 22. Carriage assembly 26 is shown holding one supplemental weight 28. The addition of carriage assembly 26 and its supplemental weight 28 increases the resistance of weight lifting apparatus 21 to weight lifter 11.

Also seen in FIG. 1 is distal carriage stop 30 which prevents carriage assembly 26 from slipping off longitudinal bar 22.

Referring now to FIG. 2, weight lifting apparatus 21 is shown having arm brace 18, crossbar 16 and carriage assembly 26. Arm brace 18 is permanently mounted at its midpoint 34 to proximal end 32 of a longitudinal bar 22. Longitudinal bar 22 is inserted and permanently fastened, preferably by welding, in slot 42 of arm brace 18. Arm brace 18 has additionally caps 20 and may be padded for the user's comfort and to prevent his arms from slipping.

Longitudinal bar 22 is seen in FIG. 2 extending from arm brace 18, through crossbar 16 and forming angle 24. Angle 24 may receive additional stress when weights are placed on carriage assembly 26. Thus, reinforcing brace 36 may be included. Crossbar 16 is shown having locking bolt 41, circumferential markings 50, longitudinal markings 52, one of which is shown. Markings 50 and 52 on crossbar 16 are an aid to the user when he places handles 66, described in FIGS. 6, 7, and 8, onto crossbar 16. Markings 50 and 52 will help the user evenly place handles 66 in mirror image positions on opposite ends of longitudinal bar 22. Crossbar 16 may be slid along longitudinal bar 22 to a length compatible with a user's forearm. Crossbar 16 is then locked into the desired position by tightening bolt 41 which is inserted in aperture 44, seen in FIG. 3. The joining of crossbar 16 to longitudinal bar 22 is shown in detail in FIG. 3.

Carriage assembly 26, which is slidably mounted on longitudinal bar 22, is also seen in FIG. 2 and is more fully explained with reference to FIG. 4.

Figure 4:
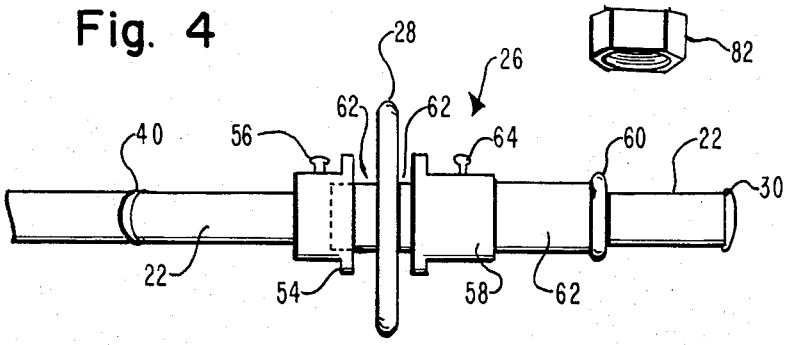
FIG. 4 is a view of the carriage assembly taken on lines 4—4 of FIG. 2 having the weight and locking collar separated to show their slide mount.

Also seen in FIG. 2 is a second carriage stop 40 which prevents carriage assembly 26 from sliding up into angle 24.Safety ridge 60 and distal carriage stop 30, explained in FIG. 4, are also shown in FIG. 2.

Referring now to FIG. 3, a cross section taken along lines 3—3 of FIG. 2, crossbar 16 is shown receiving longitudinal bar 22. Slot 48 is sized to receive longitudinal bar 22 so that crossbar 16 may slide along the length of longitudinal bar 22 between arm brace 18 and angle 24 (shown in FIG. 2). When the user has found a comfortable position for crossbar 16, he tightens bolt 41 which has been inserted through aperture 44. Also shown are circumferential marks 50 and longitudinal marks 52 for aligning handles 66 as will be more fully explained in reference to FIG. 7.

Referring now to FIG. 4, the parts of carriage assembly 26 are shown. Carriage assembly 26 is slidably mounted on longitudinal bar 22. When the desired position for carriage assembly 26 has been determined, the user tightens carriage locking bolt 56, located near the proximal end of carriage sleeve 62. Carriage locking bolt 56 secures carriage assembly sleeve 62 in place on longitudinal bar 22. Carriage assembly 26 is capable of longitudinal movement on longitudinal bar 22 only between distal carriage stop 30 and a second carriage stop 40, both of which are permanently fastened to longitudinal bar 22.

When a user wishes to add supplemental weight 28 to weight lifting device 21, he slips weight 28 over carriage stop 30, over safety ridge 60, onto carriage sleeve 62 and against backing plate 54. He then slides locking collar 58 over distal carriage stop 30, onto carriage sleeve 62, and against supplemental weight 28. Distal carriage stop 30 prevents carriage assembly 36 from slipping off longitudinal bar 22 because sleeve 62 has a smaller diameter than stop 30. Collar 58 and weights 28 have aperture diameters larger than distal stop 30 and sleeve 62, thus they can be removed when needed. The user then tightens collar locking bolt 64 to secure weight 28 tightly upright against backing plate 54. Safety ridge 60 on carriage sleeve 62 prevents locking collar 58 from slipping off carriage sleeve 62 unless collar locking bolt 64 has been fully retracted into collar 58. Thus, locking bolt 56 holds sleeve 62 on bar 22 and locking bolt 64 holds collar 58 on sleeve 62. Additionally, stop 30 prevents sleeve 62 from slipping off bar 22.

Thus, in FIG. 4 is seen the addition of supplemental weight 28 as well as the safety features of safety ridge 60 and carriage stops 30 and 40.

Additionally, it is seen in FIG. 4 that resistance may be increased or decreased in two ways. The user may increase or decrease the number of supplemental weights 28. He may also decrease resistance by moving carriage assembly 26 toward angle 24, or he may increase resistance by moving carriage assembly 26 toward distal carriage stop 30. These features provide for convenience as well as fine adjustment of resistance.

Figure 5:
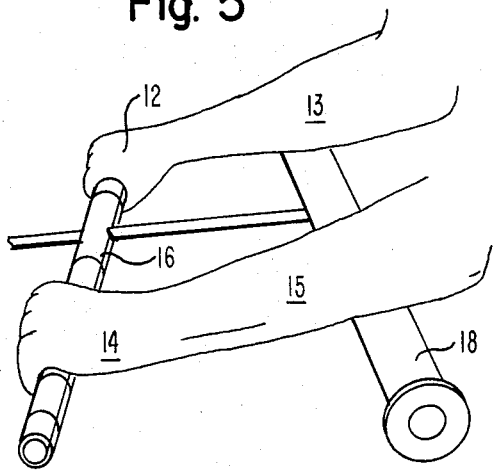
FIG. 5 shows the user's arms resting on the arm brace and his hands grasping the crossbar.

Referring now to FIG. 5, user's right hand 12 and left hand 14 are grasping crossbar 16 proximate its opposite ends. User's right forearm 13 and left forearm 15 are resting on arm brace 18. Palms of hands 12 and 14 are facing downward as are insides of lower arms 13 and 15. With hands 12 and 14, and arms 13 and 15 in this position, the user performs reverse curls and different muscles will be exercised than were possible with the hand and arm positions shown in FIG. 1.

An advantage in using device 21 of this invention is that the user may exercise different muscle groups simply by grasping crossbar 16 in the positions shown in FIG. 1 and FIG. 5. Muscle groups may be utilized differently by the addition of handles as seen in FIG. 6.

Also shown in FIG. 5 is arm brace 18. By always placing arm bracket 18 underneath his forearms 13 and 15, the user can control the upward movement of the device. If arms 13 and 15 are kept in the position shown, the effort of lifting is concentrated on the biceps, increasing the effect of the device for body builders.

Figure 6:
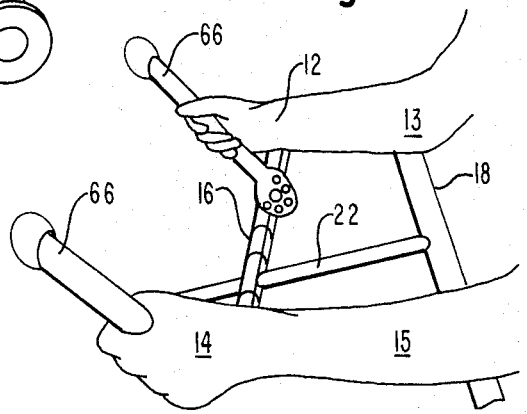
FIG. 6 is a perspective view showing the user grapsing the handles.

Referring now to FIG. 6, user's right hand 12 and left hand 14 are grasping separate handles 66 located on crossbar 16 on opposite sides of longitudinal bar 22. In FIG. 6, the palms of user hands 12 and 14 are facing each other.

Again in FIG. 6, user's forearms 13 and 15 are resting on arm brace 18. Keeping forearms 13 and 15 on arm brace 18 aids the user in proper use of exercise apparatus 21, insuring that resistance is provided for the desired arm muscles.

Figure 7:
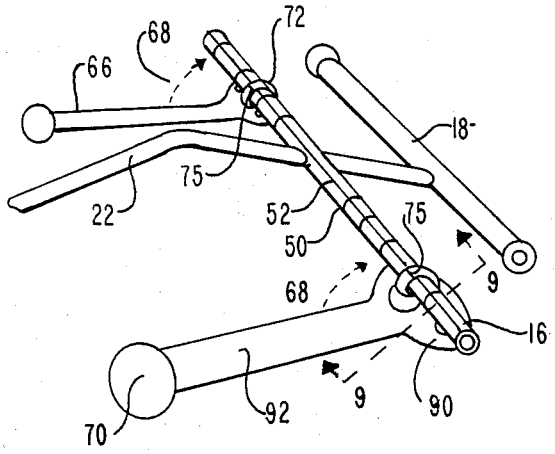
FIG. 7 is a perspective view of part of the device showing the handles pivoted on the crossbar.

Handles 66 are capable of a great variety of positions as seen in FIGS. 6, 7 and 8, and, in different positions, user's hands 12 and 14 and arms 13 and 15 will be in different positions than those shown in FIG. 6.

Referring now to FIG. 7, the rotatable nature of mushroom-shaped handles 66 is shown. Handles 66 are capable of a 360 degree rotation around crossbar 16 as shown by arrow 68. In practice, the user places handles 66 on crossbar 16, each handle at a corresponding position on opposite sides of longitudinal bar 22. He may place handle 66 on crossbar 16 at any position on a 360 degree rotation, depending on the position chosen for grasping handles 66. He is aided in placing handles 66 by markings 50 and 52 on crossbar 16 and marks 75 on handle locking assembly 72. When handles 66 are on corresponding marks 50, the weight of handles 66 will be evenly distributed along crossbar 16. He then may determine the position on the circumference of crossbar 16 for placement of handles 66. Again, longitudinal mark(s) 52 will be helpful in aligning handles 66 in corresponding positions. Handles 66 are shown to have stems 92, heads 90 and hand stops 70. The securing of handles 66 in their desired position on crossbar 16 is better shown in FIG. 9.

Referring now to FIG. 8, handle 66 is shown capable of further adjustments. Once handle 66 is placed in position on the circumference of crossbar 16 as previously described, handle 66 may be moved in the plane of the crossbar to a desired angle as indicated in phantom.

A locking device (described in FIGS. 9 and 10) holds handle head 90 in a desired rotational position by fastening U-bolt legs through aperture 88 and one of apertures 86. Stem 92 of handle 66 may then be grasped by hands 12 and 14 as shown in FIG. 6. It is advisable to secure handles 66 in mirror image positions on opposite sides of longitudinal bar 22 so as to exercise similar muscle groups in each arm simultaneously. Aid in positioning handles 66 is provided by marks 50 and 52.

Figure 9:
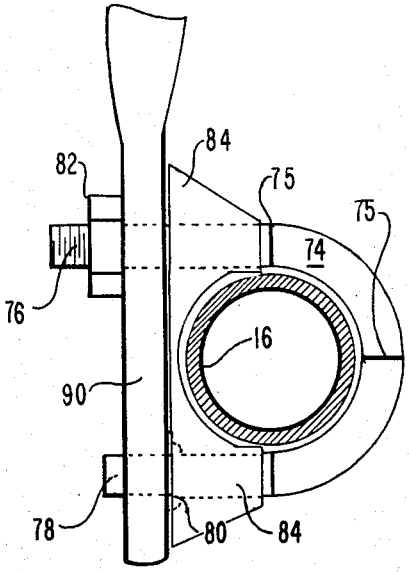
FIG. 9 is a cross section of the handle and its locking assembly taken on lines 9—9 of FIG. 7.

Now referring to FIG. 9, a cross section of handle 66 and its locking assembly 72 is shown. The parts of locking assembly 72 are not fully mated in this view, so they are not touching as they would be when locked for use. Crossbar 16 is circumscribed by U-bolt 74 and pressplate 84. U-bolt 74 has legs 78 and 76 which serve as pins. Leg 76 is threaded to receive nut 82. Leg 76 has been inserted through aperture 88 in handle head 90 (seen in FIG. 8). When nut 82 is tightened on leg 76, handle 66 is locked into position on the circumference of crossbar 16. When nut 82 is loosened, handle 66 may be rotated around crossbar 16, achieving the positions indicated in FIG. 7.

Although the bite between pressplate 84 and crossbar 16 is shown as being very narrow, this bite will differ according to the strength and size of materials being used. In all cases, torque normally achieved when nut 82 is tightened, would be suitable for the particular materials.

Markings 75 on U-bolt 74 aid in positioning handles 66. The user will align markings 75 on U-bolt 74 with longitudinal mark(s) 52 on crossbar 16, creating the positions shown in FIGS. 6 and 7.

Leg 78 extends through aperture 86 in handle head 90 (seen in FIG. 8). Aperture 86 is one of several apertures radially aligned around the edge of handle head 90. By placing leg 78 in different apertures 86, the user provides the ranging angles illustrated in FIG. 8.

Handle head 90 is secured at the desired angle by tightening nut 82 and may be moved by loosening nut 82 slightly. Fixed ring 80 draws tightly against pressplate 84 when nut 92 is fastened, holding handle head 90 firmly at diametrical positions and keeping handle 66 steady for use.

Figure 10:
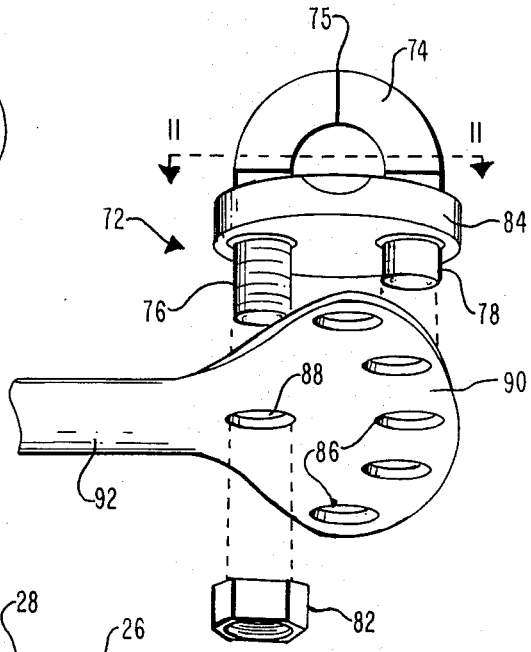
FIG. 10 is an exploded view of the handle locking assembly.

Now referring to FIG. 10, an exploded view of handle assembly 72 shows legs 76 and 78 in alignment for apertures 88 and 86. U-bolt 74, with pressplate 84 thereon, is placed around crossbar 16 (not illustrated). Handle head 90 is then placed on legs 76 and 78 so that stem 92 is at the desired angle. Markings 75 help the user align stems 92 at corresponding angles on crossbar 16 by aligning markings 75 with marks 52 on crossbar 16 (shown in FIG. 8).

When an aperture 86 has been selected, leg 78 is placed in that aperture 86. Leg 76 is already in aperture 88. Nut 82 is then tightened to secure handle head 90 in position. It should be noted that the entire handle assembly 66 does not have to be assembled or disassembled to mount on, set up in all positions including angular, or to remove it from crossbar 16. Once in place, nut 82 on leg 76, leg 76 extending through aperture 88, only has to be loosened or tightened, not removed, even for angular adjustment. This ease of adjustment is made possible by the extended length of leg 76. Nut 82 tightens handle head 90 in its rotatable position shown in FIG. 7, as well as in its angular position shown in FIG. 8.

Figure 11:
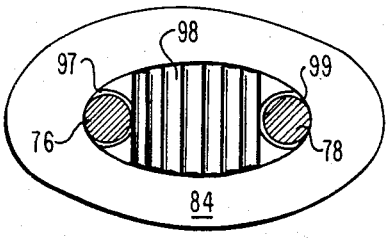
FIG. 11 is a cross section taken on lines 11—11 of FIG. 10 to show grooves 98 on a pressplate.

Now referring to FIG, 11, press plate 84 is shown having grooves 98. Grooves 98 improve the grip of press plate 84 on crossbar 16. Grooving press plate 84 will help prevent handle 66 from slipping around bar 16. Also shown in FIG. 11 are oversized apertures 97 and 99 through which legs 76 and 78 are placed respectively. Along with the countersinking of ring 80 (shown in FIG. 10), the oversizing of apertures 97 and 99 allows U-bolt 74 to rock in pressplate 84 while nut 82 is being tightened. This rocking action eliminates strains on legs 76 and 78 of U-bolt 74.

There are many alternatives to the preferred embodiment discussed above. The handle hand stops may be knobs or any other configuration which will stop a slipping hand. The handle stems are shown as cylindrical, but any comfortable shape is acceptable.

The arm brace is shown as cylindrical and padded, but any comfortable arm brace would be within the scope of this invention.

The area around slot 48 of crossbar 16 may be strengthened by a sleeve or other reinforcement for this area.

Carriage stop 30 is shown as permanent, but may be removable to allow easy mounting of carriage assembly 26.

Although all views show only one supplemental weight 28, more may be added until the desired weight is achieved.

Crossbar 16 and longitudinal bar 22 may be hollow cylinders or solid, as desired and although all bars are shown as cylinders, any configuration is possible so long as the handles and assemblies were of a complimentary configuration.

Angle 24 is shown as approximately 140 degrees, however other angles may be acceptable as long as the distal end of bar 22 stays lower than proximal end 32 when bar 22 is lifted.

A reinforcing brace 36 is shown for angle 24, but it may be omitted and still be within the scope of this invention.

Longitudinal bar 22 and slot 48 on crossbar 16 may be flattened on their upward surfaces. This configuration would help prevent a loosened crossbar 16 from turning around on longitudinal bar 22.

Handles 66 may have a roughened gripping surface to decrease slippage of the hands.

The device of this invention has many advantages. Chiefly among these is its versatility through crude and fine adjustments. It offers increased resistance by means of additional weights, as well as by placement of the carriage assembly. It is readily adjustable to the various arm lengths of users by adjusting placement of the crossbar.

The device has many safety devices. The angular nature of the longitudinal bar prevents head injuries and the several stops protect the user from mechanical slippage.

It is a device suitable for both standard and reverse wrist, forearm and bicep curls—thus it is very useful to the "body builder".

The use of the arm brace is a great advantage, eliminating the need for a curling bench to help keep the arms in an extended position for efficient working of the muscles. By moving crossbar 16 close to arm brace 18, the user may complete wrist curls without the addition of handles 66.

The great variety offered by the addition of handles is an advantage of this invention. By positioning his hands on the handles at various angles to the crossbar, the weight lifter uses different groups of muscles with a greater degree of comfort.

Another advantage is that the device of this invention requires relatively less supplemental weight than some other devices in order to achieve the same degree of resistance.

Having now illustrated and described my invention, it is not intended that such description limit this invention, but rather that this invention be limited only by reasonable interpretation of the appended claims.

What is claimed is:

1. An exercise apparatus for wrists and arms comprising:

(a) a generally longitudinal angled bar said angle located proximate said bar's midpoint;

(b) an elongated arm brace of a length sufficient to span the distance between a user's outwardly extended forearms, said brace mounted perpendicularly on and to said longitudinal bar's proximal end at said arm brace's midpoint;

(c) a transverse crossbar slidably mounted on said longitudinal bar parallel to said arm brace and between said proximal end of said longitudinal bar and said bar's angle, said crossbar adapted to receive handles;

(d) a carriage assembly slidably mounted on said longitudinal bar between said longitudinal bar's angle and said distal bar end, said assembly adapted to receive supplemental weights;

(e) two adjustable, mushroom-shaped handles, each handle including:

(i) a stem;

(ii) a generally flat circular head on one stem end, said head having a stem-aligned aperture and at least one radial aperture; and, (iii) a handle locking assembly adapted slidably and rotatably to circumscribe said crossbar, said lock including two pins intended to mate with said apertures of part (ii) to adjustably lock said handle in a multitude of radial positions, one position at a time.

2. The exercise apparatus according to claim 1 wherein said carriage assembly comprises:

(a') a carriage sleeve slidably mounted on said longitudinal bar, said sleeve including a safety ridge at one end;

(b') a slidable collar parametrically mounted around said sleeve;

(c') collar locking means to secure said collar to said sleeve;

(d') a backing plate circumscribing said sleeve proximate said sleeve's other end;

(e') carriage locking means to hold said carriage in place on said longitudinal bar; and, (f') stop means to prevent said carriage assembly from sliding into undesired positions, so that when one or more supplemental weights are mounted on said sleeve between said collar and said backing plate, said backing plate aligns said weights and said collar locking means holds said collar fast against said weights.

3. The exercise apparatus according to claim 2 wherein said collar locking means is a bolt and said collar includes an aperture to receive said bolt.

4. The exercise apparatus according to claim 2 wherein said carriage locking means is a bolt and said sleeve includes an aperture to receive said bolt.

5. The exercise apparatus according to claim 1 wherein said handle locking assembly comprises, additionally, a U-shaped bolt, each bolt end forming one of said pins, a first leg including threads to receive a nut, said other leg including a stop to align said pressplate against said crossbar, said bolt having circumferential markings to aid in placement of said handle; a press plate having two apertures through which each of said U-bolt legs pass, said press plate stabilizing said handle head; and a nut adapted to fit said threaded bolt end.

6. The exercise apparatus according to claim 1 wherein said longitudinal bar is a rod having a flattened area along at least part of its length, said flattened area preventing said crossbar from rotating around said longitudinal bar's circumference.

7. The exercise apparatus according to claim 3 wherein one of said carriage stops is a knob.

8. The exercise apparatus according to claim 1 wherein said arm brace includes circumferential padding to protect a user's arms and prevent their slippage.

9. The exercise apparatus according to claim 1 wherein said transverse crossbar is marked longitudinally and circumferentially in evenly spaced positions along said crossbar's length to evenly align said handle locking assembly.

10. The exercise apparatus according to claim 1 including, additionally, a reinforcing brace spanning said longitudinal bar's obtuse angle.

11. The exercise apparatus according to claim 1 wherein said arm brace includes caps on its ends.

12. The exercise apparatus according to claim 1 wherein said arm brace is a rod.

13. The exercise apparatus according to claim 1 wherein said transverse crossbar has a slot at generally its midpoint sized to receive said longitudinal bar.

14. The exercise apparatus according to claim 1 wherein said transverse crossbar includes a locking bolt to secure said crossbar in position and an aperture to receive said bolt.

15. The exercise apparatus according to claim 1 wherein said crossbar is cylindrical.

16. The exercise apparatus according to claim 1 including, additionally, a hand stop on said handle's stem end opposite said head.

17. The hand stop according to claim 16 wherein said stop is a knob.

* * * * *